United States Patent [19]

Boteler et al.

[11] Patent Number: 4,674,807

[45] Date of Patent: Jun. 23, 1987

[54] SHIELDED CONNECTOR

[75] Inventors: William C. Boteler, Bridgeport; Alfred L. Ehrenfels, Cheshire; David L. Lutz, North Branford, all of Conn.

[73] Assignee: Harvey Hubbell Incorporated, Orange, Conn.

[21] Appl. No.: 835,155

[22] Filed: Mar. 3, 1986

[51] Int. Cl.[4] ..... H01R 13/652

[52] U.S. Cl. ..... 439/106; 439/271; 439/607; 439/927

[58] Field of Search ..... 339/DIG. 3, 14 P, 143 R, 339/94 R, 94 M, 94 A, 94 C

[56] References Cited

U.S. PATENT DOCUMENTS

| | | | |
|---|---|---|---|
| 2,762,025 | 9/1956 | Melcher | 339/143 |
| 2,876,274 | 3/1959 | Cole et al. | 174/77 |
| 3,243,756 | 3/1966 | Ruete et al. | 339/60 |
| 3,332,052 | 7/1967 | Rusinyak | 339/177 |
| 3,336,566 | 8/1967 | Barker | 338/143 |
| 3,391,381 | 7/1968 | Livingston | 339/143 |
| 3,521,222 | 7/1970 | Andrews | 339/143 |
| 3,569,915 | 3/1971 | Sorensen et al. | 339/143 |
| 3,643,208 | 2/1972 | Massa, Jr. | 339/94 R |
| 3,739,076 | 6/1973 | Schwartz | 339/DIG. 3 |
| 3,990,765 | 11/1976 | Hill | 339/177 |
| 4,113,333 | 9/1978 | Horowitz | 339/14 P |
| 4,176,897 | 12/1979 | Cameron | 339/40 |
| 4,276,523 | 6/1981 | Boutros et al. | 333/182 |
| 4,408,816 | 10/1983 | Knecht | 339/143 |
| 4,493,525 | 1/1985 | Hall et al. | 339/143 |
| 4,531,790 | 7/1985 | Selvin | 339/143 |
| 4,531,805 | 7/1985 | Werth | 339/143 |

*Primary Examiner*—John McQuade

*Attorney, Agent, or Firm*—Jerry M. Presson; Walter C. Farley

[57] ABSTRACT

An electrical connector has an electrically non-conductive outer housing and connector members recessed in one end of the housing. Electromagnetic interference shielding is provided by members surrounding the components within the housing including an electrically conductive grommet circularly contacting conductive braid on the cable to which the connector is attached and a sleeve which surrounds the wires within the housing and extends axially to the connector end. One of the connector prongs is designated as the ground prong and is electrically attached to the sleeve. Embodiments accommodating three and four wires are disclosed.

6 Claims, 10 Drawing Figures

SHIELDED CONNECTOR

This invention relates to an electrical connector which is shielded to reduce electromagnetic interference.

BACKGROUND OF THE INVENTION

For certain equipment, particularly that used for data processing, it is desirable to shield power supply and power interconnect cables to reduce electromagnetic interference (EMI). For this purpose, it is known to use a power supply cable in which the individually insulated power and equipment grounding conductors are surrounded by a metallic braid. The braid is covered by a flexible, insulating, moisture-resistant jacket. Prior art connector structures for this purpose commonly are quite complicated and expensive to produce and generally rely upon a metal shell to accomplish at least a portion of the shielding.

SUMMARY OF THE INVENTION

An object of the present invention is to provide a power connector having an external housing of an electrically non-conductive material and a shielding arrangement within the housing to reduce electromagnetic interference.

A further object is to provide such a structure having a minimum number of components which are simple to produce and economical to assemble.

Briefly described, the invention includes an electrical connector comprising an electrically non-conductive housing having a first open end engageable with a mating connector and a second end for receiving a cable. A cable having a plurality of wires, at least some of which are insulated, is provided with a metallic braid, foil, tape or similar flexible electrically conductive members surrounding the wires and an outer, insulating cover. The cable extends into the second end of the housing and a portion of the outer cover is removed to expose a portion of the braid. A body of insulating material is mounted near the first end of the housing within the housing and supports a plurality of electrical terminal members in position to engage mating terminal members in the mating connector, the wires from the cable being connected to the terminal members, one member being designated as a ground terminal. An electrically conductive elastomeric grommet surrounds the cable within the housing and has an elastically deformable portion contacting the braid between the second end and the body of insulating material. A conductive sleeve within the housing extends axially between the grommet and the body, the sleeve abutting and making electrical contact with the grommet. The ground terminal is provided with contact means in electrical contact with the sleeve at the body so that the grommet, the sleeve and the contact form a continuous electrically conductive and electromagnetic shield within the housing between the braid and the ground terminal.

In order to impart full understanding of the manner in which these and other objectives are attained in accordance with the invention, particularly advantageous embodiments thereof will be described with reference to the accompanying drawings, which form a part of this specification, and wherein FIG. 1 is a longitudinal section through a connector in accordance with the invention, the connector being a male plug;

DESCRIPTION OF PREFERRED EMBODIMENTS

Figure 1:
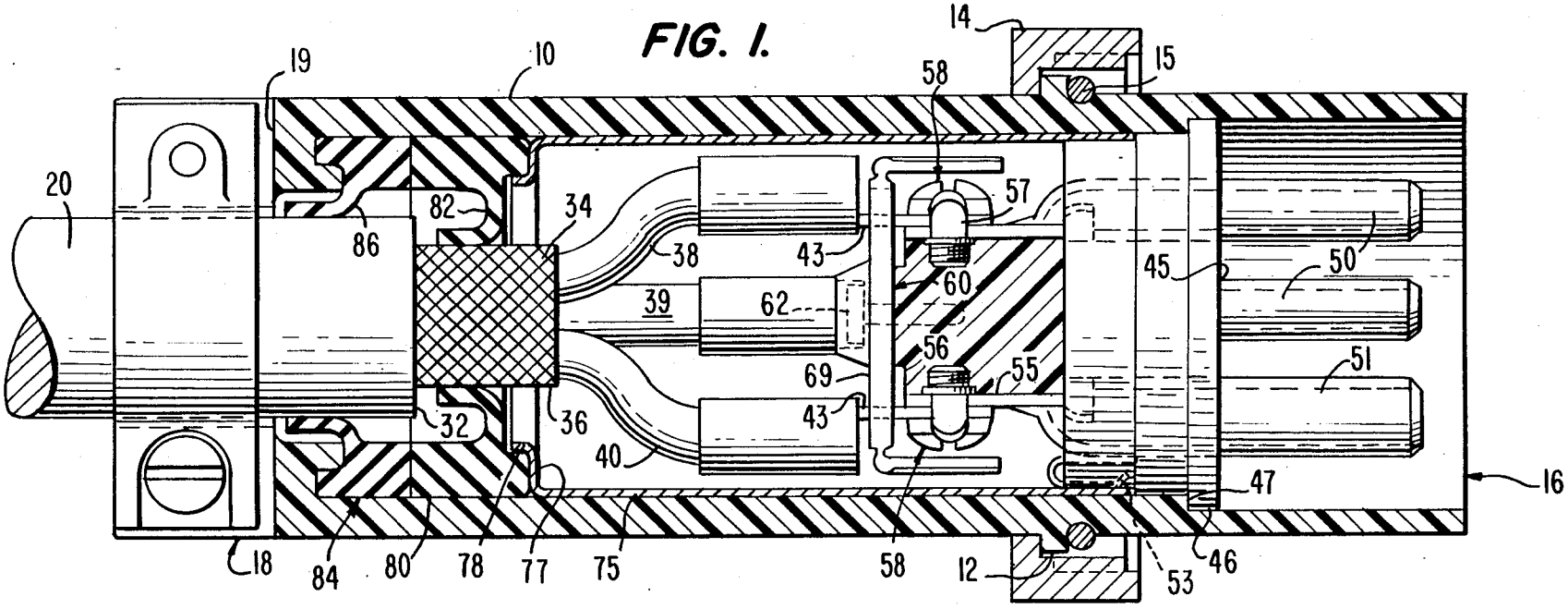
Figure 3:
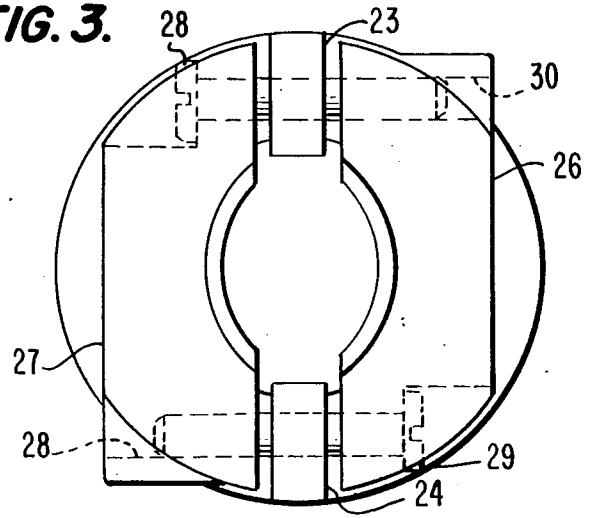
FIG. 3 is a left end elevation of the connector of FIG. 1.
Figure 2:
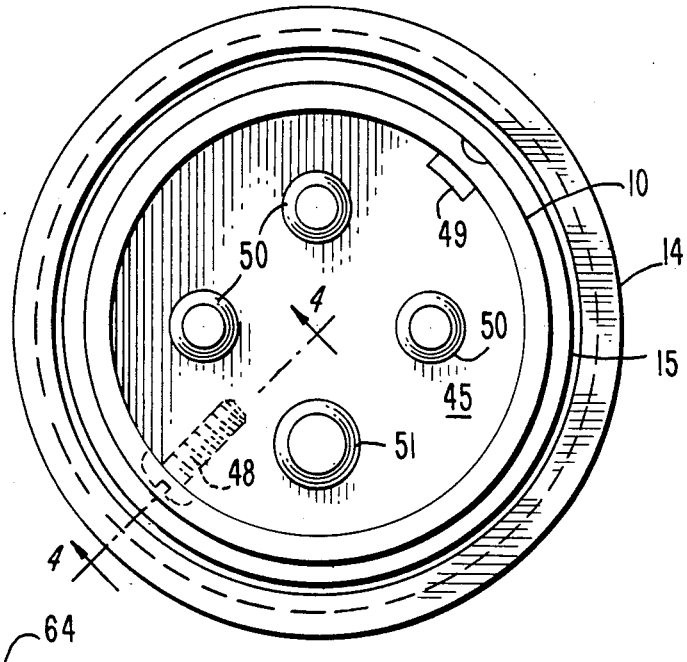
FIG. 2 is a right end elevation of the connector of FIG. 1.

Referring first to FIGS. 1, 2 and 3, it will be seen that the first embodiment of the connector in accordance with the invention includes a generally cylindrical outer housing 10 which is made of an electrically non-conductive material for safety reasons. Housing 10 is provided with an outwardly extending radial flange 12 which abuts an inwardly extending flange on an internally threaded screw ring 14 which is provided for the purpose of tightly engaging a shell of a mating connector. A sealing ring 15 provides a moisture seal with the mating connector.

Housing 10 has a first open end 16 which is shaped and dimensioned to couple with a mating connector. The other end 18 of housing 10 has an inwardly extending L-shaped radial flange 19 defining a central opening through which a multi-conductor cable 20 can be inserted. End 18 of housing 10 also has a cable clamping structure, best seen in connection with FIG. 3, which includes two axially extending mounting bars 23, 24 which are integrally attached to housing 10. Two substantially identical clamping members 26 and 27 are coupled to bars 23 and 24 by threaded fasteners 28 and 29, each clamping member having an internally threaded hole 30 to receive and threadedly engage an end of one of the fasteners 28, 29. The bars 23, 24 and the other ends of clamping members 26, 27 are provided with clearance holes through which the fasteners pass without threaded engagement. The central portions of the clamping members are shaped to engage a range of cable sizes for which the connector is intended. Bars 23, 24 can be molded onto housing 10 as a single, unitary structure.

The cable 20 is provided with an outer insulative covering 32, an electrically conductive, metallic braid 34, an inner insulating portion 36 which supports the braid, and four individually insulated conductors 38, 39 and 40 the fourth conductor being omitted from Fig. 1 for clarity of illustration. In this particular embodiment, which is designed to provide proper connection for three conductors in addition to a ground conductor, the position for the ground conductor is position 40. The ends of the conductors may be connected to standard end terminals 43 by crimping or other suitable means or may take the form of stripped conductors which can be inserted under binding head screws.

Figure 4:
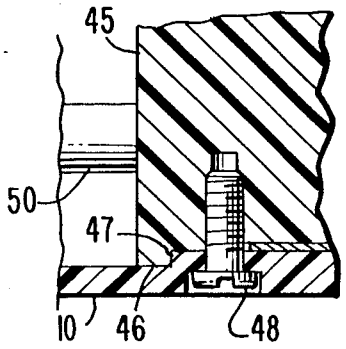
FIG. 4 is a partial sectional view along line 4—4 of FIG. 2.

Within the first open end of housing 10 is a body 45 of insulating material, the body having a flange 46 which abuts a shoulder 47 formed on the interior of the housing to limit the degrees of insertion of body 45. As seen in FIGS. 2 and 4, a screw 48 passes through an opening in the housing and threadedly engages a hole in body 45 to hold the body within the housing. A radial protrusion 49 on the interior of housing 10 engages a recess in body 45 to establish a unique rotational position of the body within the housing.

In the embodiment shown in FIGS. 1–3, the connector is formed as a male connector and the terminals therefore consist of generally circular prongs 50, 51, portions of which are embedded in body 45 and other portions of which protrude on opposite sides of that body. Those portions which protrude toward the open end 16 are dimensioned to be received in the female connector portion and are substantially identical to each other except that the ground prong 51 is significantly larger than the other three. Additionally, the ground terminal 51 is provided with a grounding clip 53 which will be further described. The portions of the terminals which protrude inwardly form body 45 comprise generally flat conductive members 55, each of which has an inwardly bent ear 56 at the end and side ears 57. A conventional screw 58 threadedly engages an opening in each flat member 55 and passes into body 45. Screws 58 thus mechanically and electrically attach terminals 43 to flat portions 55 and, thus, to prongs 50, 51.

Figure 5:
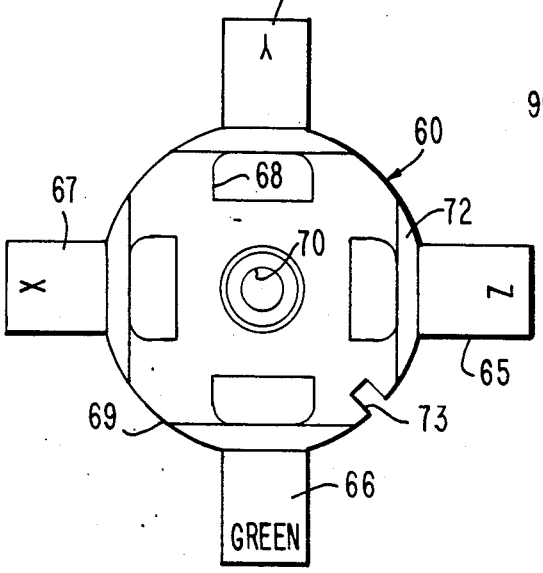
FIG. 5 is a plan view of an insulating member used in the connector of FIGS. 1–3.

An insulating spider 60 is centrally attached to the inner end of body 45 by a screw 62, spider 60 having insulating arms 64, 65, 66 and 67. Spider 60 is shown in FIG. 5 in the substantially flat form it takes before installation into a connector. The spider will be seen to have a central portion 69 which lies against the ends of ears 56 and against the inner end of body 45 with a central opening 70 to receive screw 62. Openings 68 are provided near the inner ends of arms 64–67 through body 69 to allow passage of terminals 43. The arms 64–67 are joined to body 69 by relatively thin hinge portions 72 which are relatively easily bent. Spider 60 is formed from an electrically non-conductive material such as a polymeric material or a compressed fiber material. The arms 64–67 are bent during assembly, as will be described, so that they lie outwardly of the heads of screws 58. Body 69 also has a notch 73 which receives a projection on body 45 during installation to orient spider 60 in the proper position. The arms of the spider are preferably provided with identification marks so that proper orientation of the spider is assured.

An electrically conductive sleeve or shell 75 is snugly received within housing 10 and surrounds a portion of body 45, the body being provided with a recess for that purpose. Body 45 is also provided with a recess between prong 51 and sleeve 75 for clip 53 so that, upon assembly, clip 53 can slidably engage the inner surface of sleeve 75 to electrically connect those two components together. Sleeve 75 is substantially continuous in the circular direction, i.e., it has no significant gaps which would allow EMI leakage, and can be formed by drawing or molding. The inner surface of sleeve 75 can be provided with a coating of insulating material, not shown, or with a separate inner insulating sleeve to enhance the electrical separation between the sleeve 75 and live electrical components within the connector. Alternatively, the sleeves may be formed of a nonconductive material coated with an electrically conductive material.

At the other end of sleeve 75 is a radial inward flange portion 77 which terminates in an axially extending flared portion 78. In the fully assembled condition, flange 77 and flared portions 78 surround the inner end of the braided portion 34 of cable 20. Adjacent this end of sleeve 75 is an elastomeric grommet 80 which is made from an electrically conductive elastomeric material, commonly referred to as conductive rubber, which has an annular body and a radially inwardly extending diaphragm 82 dimensioned to slidably engage the braid 34 on any one of a number of sizes of cable with which the connector is intended to be used. It will be observed in FIG. 1 that an axially facing surface of the body of grommet 80 abuts the outer surface of flange portion 77 of sleeve 75, thereby making electrical contact with both the sleeve and with braid 34.

A grommet 84 lies between the inner end of housing 10 and grommet 80 and supplies a compressive force to maintain grommet 80 in good contact with shell 75. Grommet 84 also has an inwardly extending diaphragm portion 86 which engages the outer surface of the insulative covering of cable 20 for the purpose of providing a moisture seal.

The assembly of the connector is relatively simple. With clamping members 26 and 27 moved outwardly to a position which allows the cable to pass therethrough, a cable 20 is inserted through end 18 of the connector housing far enough so that the end having the exposed wires passes entirely through housing 10 and extends out of end 16. Grommets 80 and 84 and sleeve 75 are inserted into the interior of housing 10. A portion of the insulation 32 is removed from the cable to expose braid 34 and a further portion of the braid and insulation 36 is removed to allow access to the insulated wires. The wires are stripped and provided with connectors 43. This can also be accomplished before the cable is inserted through the housing. Connectors 43 are then passed through openings 68 in spider 60 mounted on body 45 and are connected to flat portions 55 of the terminal members using screws 58. The cable is then withdrawn through the opening at end 18 of the housing and body 45 is pushed into end 16 of the housing until it occupies the position shown in FIG. 1. In the process of inserting this assembly into the housing, outwardly protruding arms 64–67 on spider 60 are bent inwardly by contact with the wall of the housing 10 until they occupy a position similar to that shown in FIG. 1, each arm lying radially outwardly of a screw 58 to prevent inadvertent contact between the screw and sleeve 75 or between sleeve 75 with any loose wires which might exist in the vicinity of terminals 43. Screw 48 is then inserted to position and secure body 45 and screws 28 and 29 are tightened to bring the clamping members into engagement with the outer portion of cable 20. This completes the assembly of the connector which is now ready for connection to a mating female member.

It will be observed that a complete EMI shield is provided around all components within the connector from one end to the other. Specifically, the conductors within cable 20 are totally surrounded by braid 34 until that braid terminates within housing 10. The braid itself is contacted by diaphragm 82 of grommet 80 which completely surrounds the cable and provides circular abutting contact with one end of sleeve 75. The sleeve, which totally surrounds the wires within the housing, extends to the point at which it is grounded against prong 51. This connector is designed for use in connection with a female connector, to be described, in which the ground receptacle portion is elongated more than the other connector portions, thereby making the ground connection first and separating the ground connection last to "drain" any remaining charge in sleeve 75. Thus, the EMI shielding is quite effective and complete.

Figure 6:
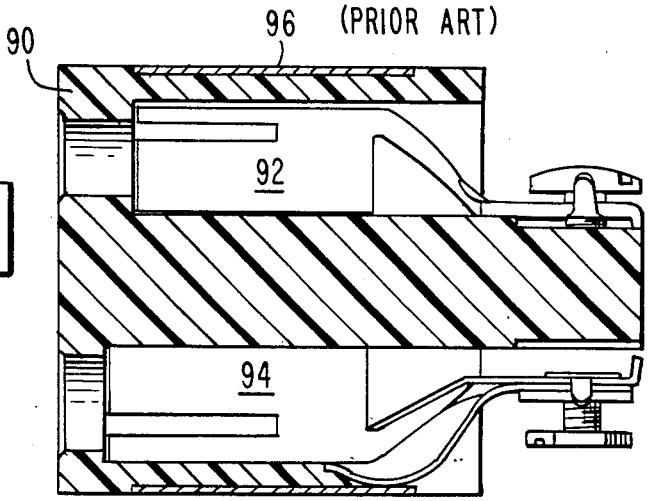
FIG. 6. (PRIOR ART)
FIG. 6 is a side elevation, in section, of a suitable mating connector for use with the connector of FIGS. 1–3.
Figure 7:
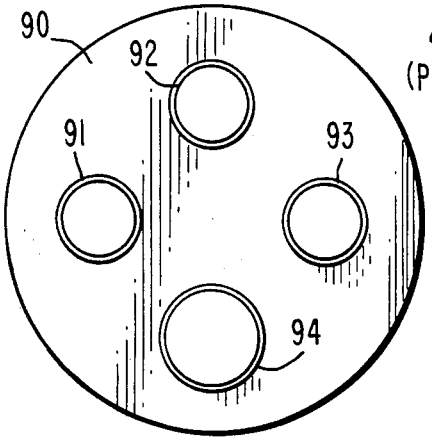
FIG. 7. (PRIOR ART)
FIG. 7 is a left end elevation of the connector of FIG. 6.

A female connector of the type to which reference is made is shown in FIGS. 6 and 7. Although this does not form a part of the present invention, it is described in order to clarify the environment in which the connector of the present invention is used. As shown therein, a generally cylindrical insulating body 90 is provided with a plurality of tubular conductive connector members 91, 92, 93 and 94, member 94 being designated as the ground connector and being larger in diameter than the others to receive a prong 51. Housing 90 is provided with openings so that the prongs can pass therethrough into the electrically conductive connectors. The other ends of the connectors are provided with screw attachments for connection to wires within equipment or within another cable. A surrounding electrically conductive sleeve 96 provides shielding around the connector portions, this entire structure being designed to be housed within a metal shell which contacts sleeve 96. The metal shell is provided with external threads to engage internally threaded ring 14.

As seen in FIG. 6, connector 94 extends further toward the face of the body than the other connectors. Thus, it makes first contact with prong 51 and forms the ground connection first. If the female connector is not so formed, prong 51 can be made longer than the other connector prongs.

Figure 8:
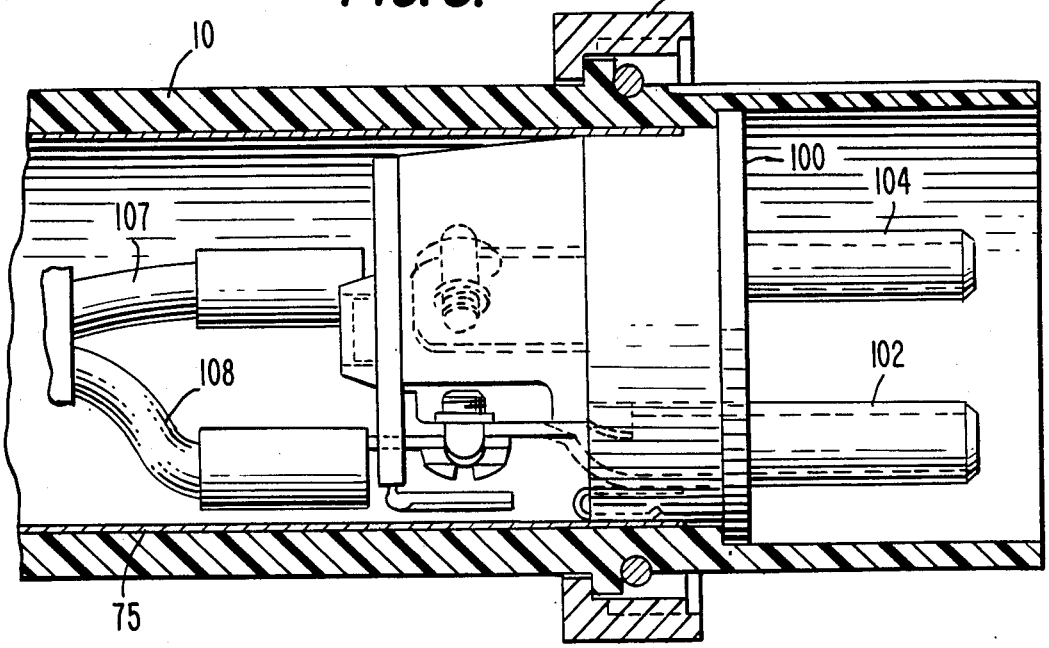
FIG. 8 is a partial side elevation, in partial section, of a further embodiment of a connector in accordance with the invention.
Figure 9:
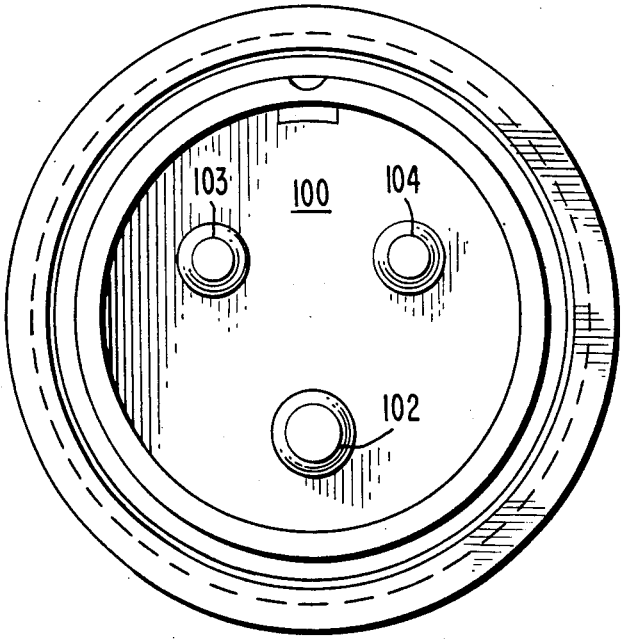
FIG. 9 is a right end elevation of the connector of FIG. 8.
Figure 10:
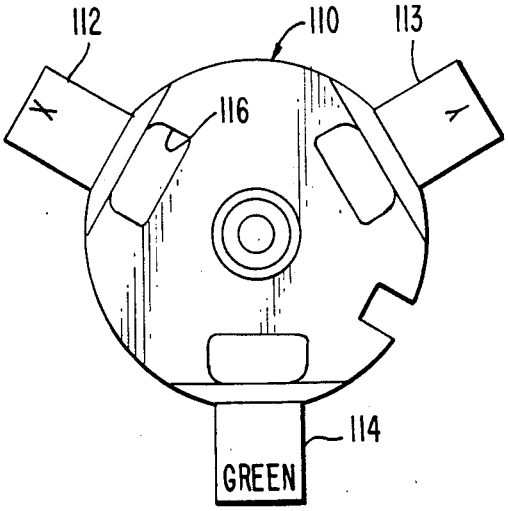
FIG. 10 is a plan view of an insulating member usable in the connector of FIGS. 8 and 9.

FIGS. 8, 9 and 10 illustrate a further embodiment of a connector in accordance with the invention which is designed to accommodate three wires rather than four. The housing is the same as discussed in connection with FIGS. 1–3 as is sleeve 75, grommets 80 and 84, and the cable clamps which are not illustrated in FIG. 8. Body 45 is replaced by a body 100 which carries a ground prong 102 and "hot" prongs 103 and 104. Three wires, of which wires 107 and 108 are visible in the figure, are connected to the inner portions of the prongs in the same manner as discussed in connection with FIG. 1. The only other significant difference is the form of the spider 110 which is provided with three arms 112, 113 and 114 and with openings 116 spaced approximately 120° apart as are prongs 102–104. A symmetrical connector is thus formed which is mateable with a female connector, similar in nature to that shown in FIGS. 6 and 7, but with the appropriate separation of components by 120°.

While certain advantageous embodiments have been chosen to illustrate the invention, it will be understood by those skilled in the art that various changes and modifications can be made therein without departing from the scope of the invention as defined in the appended claims.

What is claimed is:

1. An electrical power connector comprising an electrically nonconductive housing having a first open end engageable with a mating connector and a second end for receiving a cable;

a cable having a plurality of wires at least some of which are individually insulated, an electrically conductive, electromagnetic interference shield surrounding said wires and an outer, insulating cover, said cable extending into said second end and having a portion of said outer cover removed to expose a portion of said shield;

a body of insulating material near said first end of said housing;

a plurality of electrical terminal members supported by said body in positions to engage terminal members in a mating connector, said wires being connected to said terminal members supported by said body, one of said terminal members being constructed as a ground terminal;

contact means surrounding said cable within said housing to provide a continuous electromagnetic interference shield, said contact means comprising an electrically conductive elastomeric grommet having a deformable portion contacting said shield between said second end and said body;

an electrically conductive sleeve member within said housing and extending axially between said contact means and said body, said sleeve member making electrical contact with said contact means;

means on said ground terminal in electrical contact with said sleeve member at said body, said contact means and said sleeve member forming a continuous electrically conductive, electromagnetic interference shield within said housing between said shield and said ground terminal; and an elastomeric seal member between said second end and said sleeve, said seal member including an elastomeric annular portion contacting the inner surface of said housing and a radially inwardly extending diaphragm having a central opening with a significantly smaller diameter, in an undeformed condition, than the outer diameter of said insulating cover of said cable so that said cable can be pushed beyond said seal member for connection of said wires to said terminal members and partially retracted, causing the inner portion of said diaphragm to lie along and tightly surround said insulating cover.

2. A connector according to claim 1 wherein said housing is a substantially circular cylinder and said grommet comprises an annular member and said deformable portion includes a radially inwardly extending second diaphragm having a central opening with a significantly smaller diameter, in an undeformed condition, than the outer diameter of said shield of said cable so that said exposed portion of said shield can be pushed beyond said grommet for connection of said wires to said terminal members and partially retracted, causing the inner portion of said second diaphragm to lie along and tightly surround said shield for making substantially continuous contact with said shield around said cable.

3. A connector according to claim 2 wherein said terminal members supported by said body are male prongs, the ground terminal prong having a greater diameter than the other prongs.

4. A connector according to claim 3 wherein said body is recessed inwardly from said first end so that said prongs are totally within said housng.

5. A connector according to claim 4 wherein said sleeve member is a continuous circularly cylindrical electrically conductive member.

6. An electrical power connector comprising an electrically nonconductive housing having a first open end engageable with a mating connector and a second end for receiving a cable;

a cable having a plurality of wires at least some of which are individually insulated, an electrically conductive, electromagnetic interference shield surrounding said wires and an outer, insulating cover, said cable extending into said second end and having a portion of said outer cover removed to expose a portion of said shield;

a body of insulating material near said first end of said housing, said body including a generally cylindrical portion extending away from said first end and having an end face, said wires being connected to terminal members at circularly spaced locations around said generally cylindrical portion;

a plurality of said electrical terminal members supported by said body in positions to engage terminal members in a mating connector, said wires being connected to said terminal members supported by said body, one of said terminal members being constructed as a ground terminal;

contact means surrounding said cable within said housing to provide a continuous electromagnetic interference shield, said contact means having a deformable portion contacting said shield between said second end and said body;

an electrically conductive sleeve member within said housing and extending axially between said contact means and said body, said sleeve member making electrical contact with said contact means;

means on said ground terminal in electrical contact with said sleeve member at said body, said contact means and said sleeve member forming a continuous electrically conductive, electromagnetic interference shield within said housing between said shield and said ground terminal;

an insulating spider having a central portion and a plurality of radial arms equal in number to the number of terminal members; and means for attaching said central portion of said spider to said end face of said body with said radial arms lying over said circularly spaced locations to provide insulating barriers between said wire-terminal member connections and said sleeve member.

* * * * *